US005410241A

United States Patent [19]

Cecil

[11] Patent Number: 5,410,241

[45] Date of Patent: Apr. 25, 1995

[54] CIRCUIT TO REDUCE DROPOUT VOLTAGE IN A LOW DROPOUT VOLTAGE REGULATOR USING A DYNAMICALLY CONTROLLED SAT CATCHER

[75] Inventor: James B. Cecil, Santa Clara, Calif.

[73] Assignee: National Semiconductor Corporation, Santa Clara, Calif.

[21] Appl. No.: 36,777

[22] Filed: Mar. 25, 1993

[51] Int. Cl.[6] ..... G05F 3/16

[52] U.S. Cl. ..... 323/315; 323/312; 323/314

[58] Field of Search ..... 323/312, 313, 314, 315; 307/280, 300, 296.2, 296.6

[56] References Cited

U.S. PATENT DOCUMENTS

| | | | |
|---|---|---|---|
| 4,345,166 | 8/1982 | Allen et al. | 307/296 R |
| 4,532,467 | 7/1985 | Mensink et al. | 323/314 X |
| 4,626,770 | 12/1986 | Price, Jr. | 323/313 |
| 4,675,593 | 6/1987 | Minakuchi | 323/314 |
| 4,794,277 | 12/1988 | Holland | 323/315 X |
| 4,843,303 | 6/1989 | Shoji | 323/313 |
| 5,084,668 | 1/1992 | Kotowski et al. | 323/315 |
| 5,248,932 | 9/1993 | Prentice | 323/315 |

FOREIGN PATENT DOCUMENTS

0498727A1 8/1992 European Pat. Off. .

OTHER PUBLICATIONS

"LM2935 Low Dropout Dual Regulator," *General Purpose Linear Devices Databook*, 1989, pp. 1-226 through 1-233.

"LM2937 500 mA Low Dropout Regulator," Nov. 1991, pp. 1 through 6.

"LM2940 1A Low Dropout Regulator," *General Purpose Linear Devices Databook*, 1989, pp. 1-239 through 1-243.

"LP2950/LP2950AC/LP2950C 5V and LP2951/LP2951AC/LP2951C Adjustable Micropower Voltage Regulators," *General Purpose Linear Devices Databook*, 1989, pp. 1-345 through 1-356.

"LP2952/LP2952A/LP2953/LP2953A Adjustable Micropower Low-Dropout Voltage Regulators," Feb. 1991, pp. 1 through 15.

"LP2954/LP2954A 5V Micropower Low-Dropout Voltage Regulators," Jan. 1991, pp. 1 through 8.

*Primary Examiner*—Steven L. Stephan
*Assistant Examiner*—Y. Jessica Han
*Attorney, Agent, or Firm*—H. Donald Nelson; Lawrence E. Lycke; Richard J. Roddy

[57] ABSTRACT

An integrated circuit voltage regulator employs a PNP pass transistor to produce a low dropout voltage. Saturation in the pass transistor produces excessive substrate current which appears in the form of wasted current which lowers the regulator efficiency. A current conducted by the sat catcher circuit is employed to avoid pass transistor saturation. The sat catcher is controlled dynamically so the dropout voltage is minimized and the voltage regulator maintains good performance at high regulator output currents.

24 Claims, 4 Drawing Sheets

CIRCUIT TO REDUCE DROPOUT VOLTAGE IN A LOW DROPOUT VOLTAGE REGULATOR USING A DYNAMICALLY CONTROLLED SAT CATCHER

BACKGROUND OF THE INVENTION

In voltage regulators dropout is defined as the input-output voltage differential at which the circuit ceases to regulate against further reductions in input voltage. A low dropout voltage is of maximum interest in battery-operated equipment where the supply voltage declines with time. First, a low dropout voltage means that less power is dissipated in the pass transistor so that efficiency is improved. Second, as the battery voltage declines with time, low dropout voltage means that a greater voltage decline can be tolerated before the battery must be replaced or recharged.

In the typical low dropout voltage regulator, using conventional IC construction, the pass transistor is constructed as a large area PNP lateral transistor. FIG. 1 is a schematic diagram of a typical low dropout IC voltage regulator. The circuit is typically manufactured using silicon epitaxial planar, PN junction isolated, construction which is well known in the art. The circuit receives a + input at terminal 10, referenced against ground terminal 11, and provides a regulated output at terminal 12. PNP pass transistor 13 has an area that is from 25 to several hundred times that of a minimum area device. The base of transistor 13 is driven by a common emitter NPN driver 14, which has a biasing resistor 15 connected between its base and emitter. This resistor sets the current flowing in transistor 17. Emitter resistor 16 degenerates the gain in transistor 14 and its collector current is set by source 38. Common collector NPN transistor 17 acts as an emitter follower that drives the base of transistor 14 through resistor 18. PNP transistor 19 acts as a bias level shifting emitter follower that drives the base of transistor 17. Current source 20 sets the emitter current in transistor 19. A differential amplifier (diff-amp) 21 forms the amplifier input stage. The current in transistors 22 and 23, which respectively form the noninverting and inverting inputs, are set by the current source 24. NPN transistors 25 and 26 form a current mirror load in input stage 21. Load input transistor 25 is diode connected and includes base resistor 27. Load output transistor 26 and the output of transistor 23 provides a single ended drive for the base of transistor 19. Transistor 26 also includes base resistor 28 and a frequency compensation network composed of resistor 29 and capacitor 30.

A conventional bandgap reference circuit 31 produces a temperature independent constant voltage which is connected to the base of transistor 22. This reference voltage is typically 1.25 volts. Resistors 32 and 33 form a voltage divider connected between output termnal 12 and ground. The divider tap, node 34, is connected to the base of transistor 23 to provide the regulator negative feedback which stabilizes the circuit operation. The output voltage at terminal 12 will be driven to that level, which results in the voltage at node 34 being equal to the reference voltage at the base of transistor 22. Since a high gain negative feedback loop is involved, the output voltage will be held constant regardless of changes in temperature, input voltage and regulator load current.

When a PNP transistor, such as element 13 goes into saturation, its construction is such that it will inject minority carriers into the IC chip N type epitaxial region. These carriers are collected by the P type isolation material and thereby flow into the chip substrate. This substrate current can cause voltage drops along the chip which can adversely affect adjacent active devices. Furthermore, this excessive substrate current is lost and contributes nothing to the output current. Thus, it only serves to heat the IC chip and represents a reduction in efficiency. Accordingly, a circuit action is incorporated into the structure to reduce or avoid saturation in transistor 13. This circuit action is designated a "sat catcher" and is accomplished by transistor 35 which operates in the following manner.

PNP transistor 35 has its emitter connected to the collector of transistor 13 and its base is connected to the base of transistor 13. Under normal operating conditions sat catcher 35 will be off. As transistor 13 approaches saturation, and its collector rises above its base, sat catcher 35 will turn on and supply current to the base of transistor 36, which will thereby conduct and pull the base of transistor 14 down which will reduce the drive to the base of transistor 13 which rises. When sat catcher 35 is off, during normal circuit operation, resistor 37 returns the base of transistor 36 to ground thereby turning it off. It can be seen that conduction in sat catcher 35 will clamp the collector of transistor 13 at a potential equal to $V_{IN}+V_{BE35}-V_{BE13}$. This means that the regulator dropout potential is increased from the $V_{SAT}$ of transistor 13 to the base to emitter potential differential between transistors 13 and 35 which, while higher than a $V_{SAT}$, is still well below a $V_{BE}$.

FIG. 2 is a graph showing the performance of the FIG. 1 circuit at 25° C. Curve 39 is a plot of the $V_{BE}$ of transistor 13. Curve 40 shows a theoretical linear plot of 60 mv/decade which serves to show the departure of the $V_{BE}$ of transistor 13 from theoretical linearity, at the higher currents. Curve 41 is a plot of the $V_{BE}$ of transistor 35. The regulator dropout voltage would be curve 41 subtracted from curve 39. Clearly, at high currents, the $V_{BE}$ of transistor 13 dominates the dropout voltage.

SUMMARY OF THE INVENTION

It is an object of the invention to reduce the dropout voltage in a voltage regulator using a PNP pass transistor in which heavy saturation of the output PNP is avoided.

It is a further object of the invention to employ a sat catcher in a voltage regulator circuit in which the heavy saturation PNP pass transistor is avoided and the dropout voltage is dynamically decreased as a function of pass transistor current.

These and other objects are achieved as follows. A voltage regulator employs a sat catcher circuit which avoids heavy saturation in the PNP pass transistor. A small portion of the pass transistor current is mirrored into the sat catcher transistor so that its $V_{BE}$ rises along with pass transistor current. Accordingly, the dropout voltage does not rise as steeply with current as is the case where the sat catcher current is maintained substantially constant.

DESCRIPTION OF THE INVENTION

Figure 1:
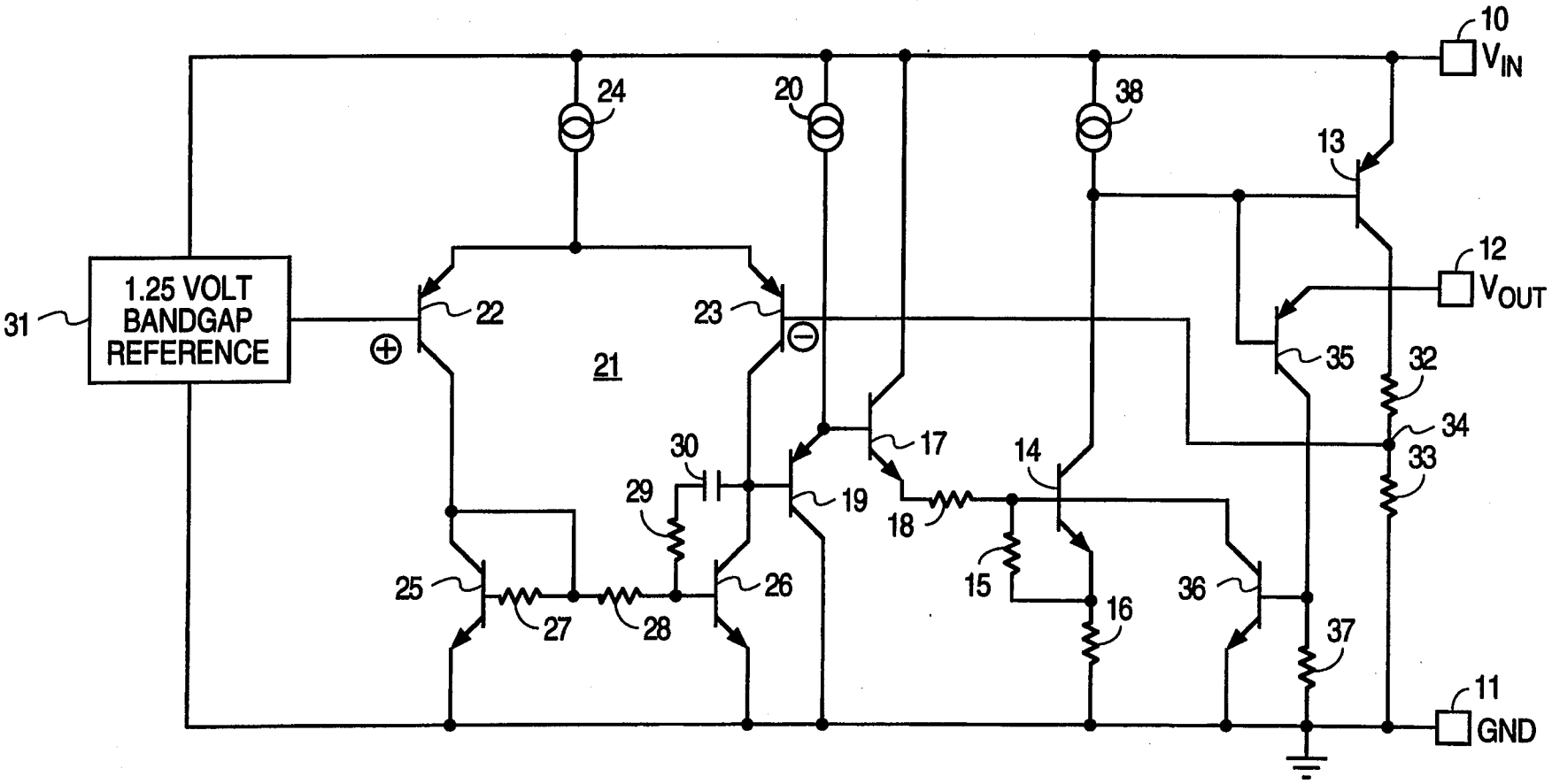
FIG. 1 (PRIOR ART)
FIG. 1 is a schematic diagram of a prior art voltage regulator IC that employs a PNP pass transistor and a sat catcher.
Figure 3:
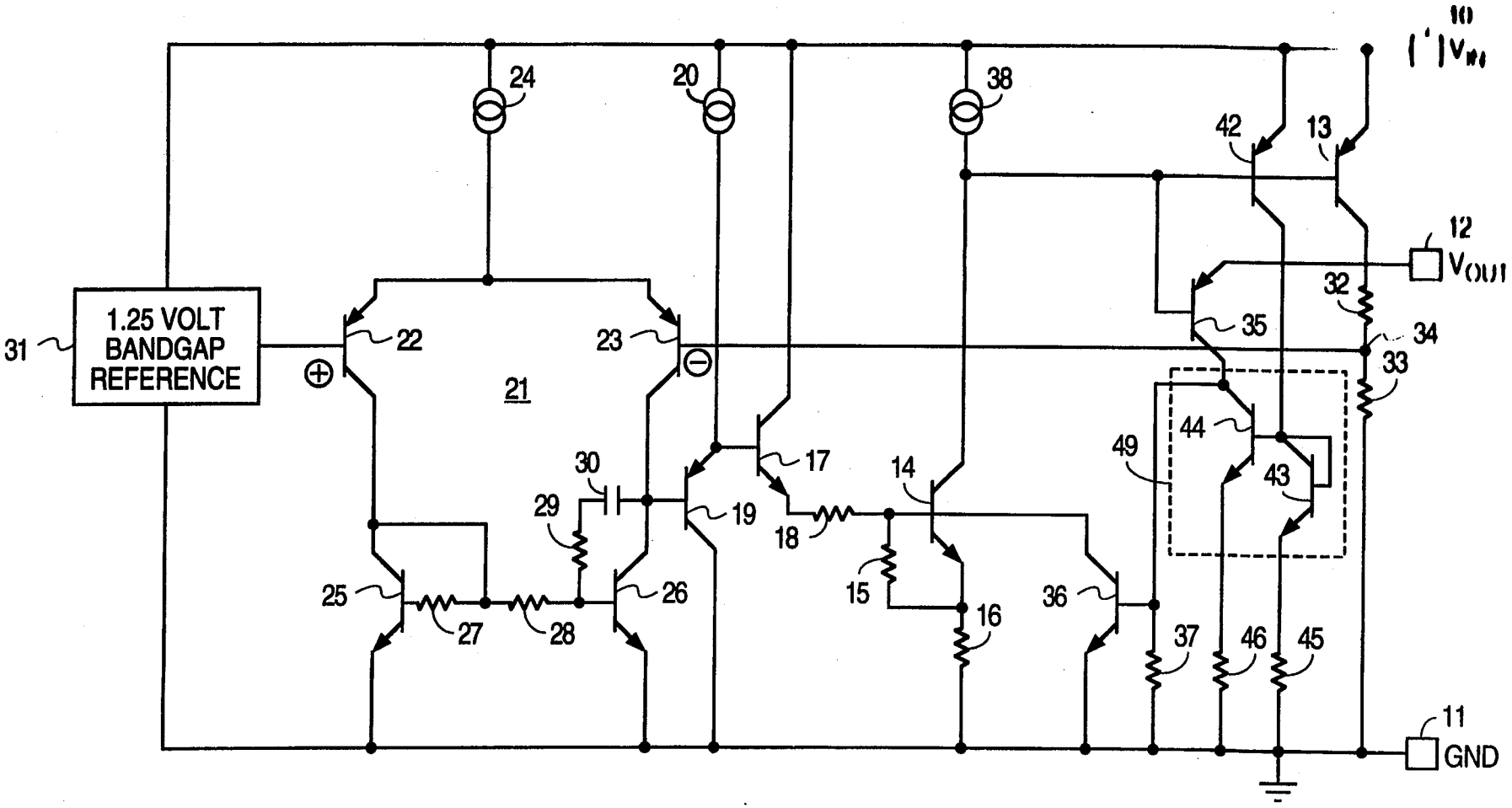
FIG. 3 is a schematic diagram of a voltage regulator in accordance with one embodiment of the invention.

FIG. 3 is a schematic diagram of a voltage regulator in accordance with one embodiment of the invention. Where the parts function, as do those of FIG. 1, the same numerals are employed. All of the components, 10 through 34 and 36 through 38, function as they do those of FIG. 1. However, the current passed by sat catcher 35 is obtained differently. While in FIG. 1 the current flowing in sat catcher 35 is substantially constant and equal in value to:

$$I_{35}=V_{BE36}/R_{37}$$

where: $V_{BE36}$ is the base to emitter voltage of transistor 36 and $R_{37}$ is the value of resistor 37.

Figure 2:
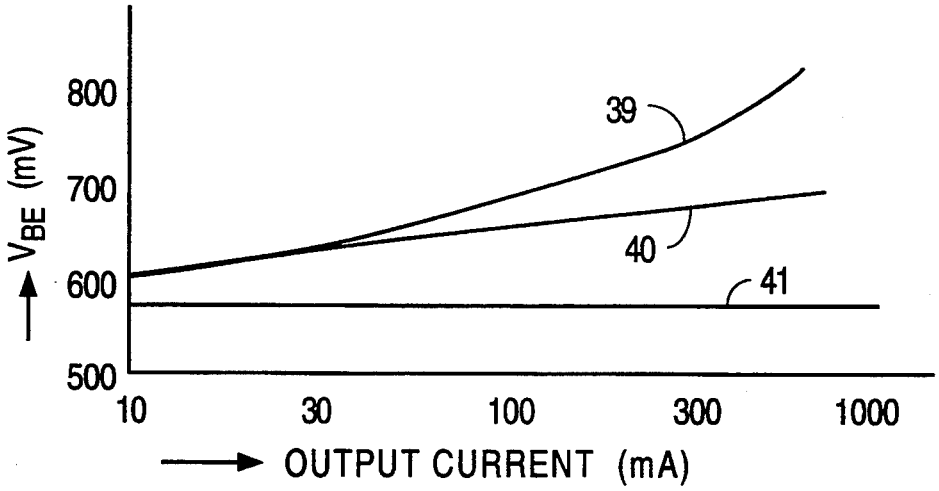
FIG. 2 (PRIOR ART)
FIG. 2 is a graph showing the $V_{BE}$ of the PNP pass transistor and the sat catcher of FIG. 1 as a function of output current.
Figure 4:
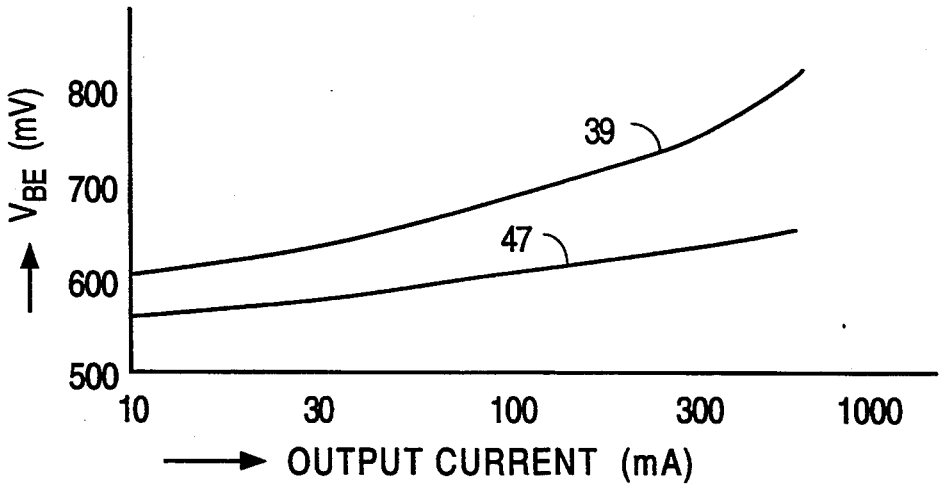
FIG. 4 is a graph showing the $V_{BE}$ of the PNP pass transistor and the sat catcher of FIG. 3 as a function of output current.

In FIG. 3, transistor 42 has its base-emitter circuit in parallel with that of PNP pass transistor 13 and mirrors a small fraction of the regulator $V_{OUT}$ terminal 12 current. Therefore, the current flowing into current mirror 49 will vary with regulator load current. Transistor 42 is made to be a small fraction of the size of transistor 13 (a typical ratio is 1/400) so that a small current proportional to output load current will flow into the current mirror 49. The reflected output current flows in diode-connected transistor 43 and resistor 45. Under dropout conditions, output transistor 44 will then sink a variable current from sat catcher 35, which no longer operates at a relatively constant current. As PNP pass transistor 13 is pushed closer to saturation to supply increasing output current, the current in sat catcher 35 will now be $V_{BE36}/R_{37}$ plus the collector current of transistor 44. Thus, any increase in the $V_{BE}$ of transistor 13 is partially offset by an increase of the $V_{BE}$ of sat catcher 35. This action is shown in the graph of FIG. 4. It can be seen that curve 39 (the $V_{BE}$ of transistor 13) is the same as that of FIG. 2, but the $V_{BE}$ of sat catcher 35, as shown in curve 47, rises proportionally. This is to be contrasted with curve 41 of FIG. 2. Since the difference between curves 39 and 47 is substantially reduced at the higher current values, the regulator circuit high current dropout is substantially reduced. Typically, at 400 ma curve 47 of FIG. 4 will be about 10 mv higher that curve 41 of FIG. 2. A proportionate reduction in dropout voltage is present.

Figure 5:
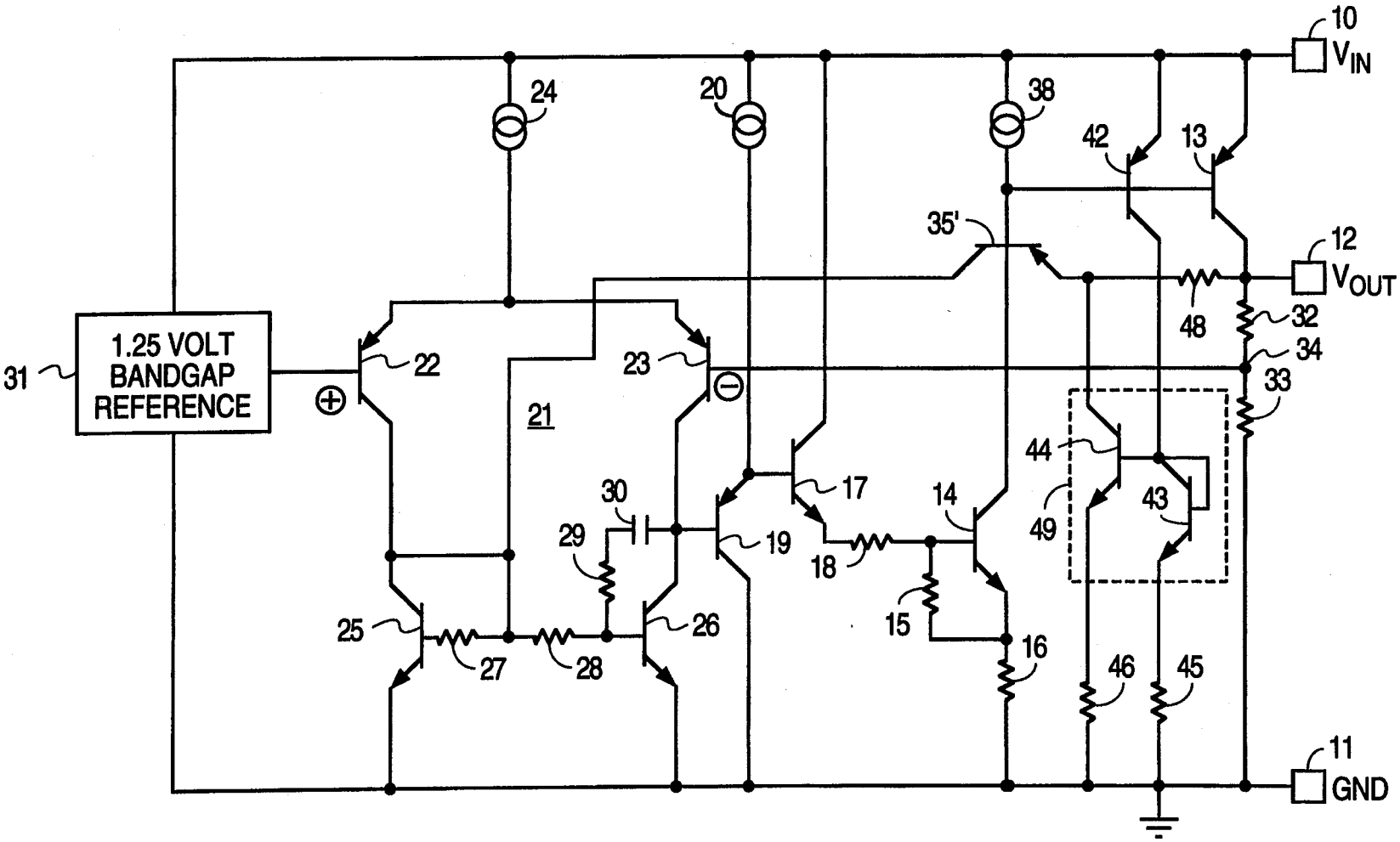
FIG. 5 is a schematic diagram of a voltage regulator in accordance with another embodiment of the invention.

FIG. 5 is a schematic diagram of a voltage regulator in accordance with another embodiment of the invention. Again, where the components operate the same as those of FIG. 1, the same numbers are used. Here sat catcher 35' is connected differently. Its base is connected to the base of transistor 13 its collector is connected to the collector of transistor 25 and its emitter is coupled via a relatively small value (on the order of 200 ohms) resistor 48 to the collector of transistor 13. The collector of transistor 44 is connected to the juncture of the emitter of sat catcher 35' and resistor 48. When the PNP pass transistor 13 approaches saturation, sat catcher 35' will turn on and inject current into the collector of transistor 25. This injected current will offset the error amplifier in such a way as to reduce the base drive to the pass PNP transistor 13. It can be seen that the collector current of transistor 44, which tracks the regulator load current, flows in resistor 48, thereby producing a voltage drop which will add to the $V_{BE}$ of of the sat catcher 35'. In this embodiment the $V_{BE}$ of sat catcher 35' remains relatively constant and the voltage drop across resistor 48 provides the dynamic dropout reduction.

EXAMPLE

The circuit of FIG. 5 was constructed using conventional monolithic silicon IC construction with planar, epitaxial, pn junction isolated parts. PNP pass transistor 13 had an area of about 400 times that of transistor 42 so that at an output of 150 ma, the current in transistor 42 was about 0.4 ma. The following components were employed:

| COMPONENT | VALUE |
|---|---|
| Resistor 16 | 18 ohms |
| Resistor 18 | 0 ohms |
| Current Source 20 | 3 microamperes |
| Current Source 24 | 6 microamperes |
| Resistor 27 | 110 ohms |
| Resistor 28 | 100 ohms |
| Resistor 29 | 350 ohms |
| Capacitor 30 | 40 pf |
| Current Source 38 | 3 microamperes |
| Resistor 32 | 135.7k ohms |
| Resistor 33 | 42.9k ohms |
| Resistor 45 | 1.0k ohms |
| Resistor 46 | 2.0k ohms |
| Resistor 48 | 400 ohms |

In place of resistor 15, an 0.06 uA current source was used from the base of transistor 14 to ground. The circuit produced a regulated output of 5 volts and could supply over 150 ma without saturating transistor 13. The maximum dropout voltage at 150 ma was 250 ma millivolts. With transistor 44 disabled, the dropout was 100 mv higher.

The invention has been described and a preferred embodiment detailed. Alternatives have also been described. When a person skilled in the art reads the foregoing description, other alternatives and equivalents, within the spirit and intent of the invention, will be apparent. Accordingly, it is intended that the scope of the invention be limited only by the claims that follow.

I claim:

1. An integrated voltage regulator circuit comprising:

a PNP pass transistor having a base and a collector;

a PNP sat catcher transistor having an emitter coupled to said pass transistor collector, a base coupled to said pass transistor base, and a collector; and means coupled to said sat catcher transistor collector for varying a current flowing in said sat catcher transistor substantially in proportion to a current flowing in said pass transistor so that the base-to-emitter voltage of said sat catcher transistor rises with an increase in said pass transistor current, wherein said means coupled to said sat catcher transistor comprises:

a current sense means for sensing said current flowing in said pass transistor and providing a sense current, said sense current being proportional to said current flowing in said pass transistor, and a current source having an input terminal and an output terminal, said input terminal being coupled to receive said sense current, said current source conducting from said output terminal of said current source an output current substantially proportional to said sense current.

2. The integrated voltage regulator circuit of claim 1 wherein, the drop out voltage of said integrated voltage regulator circuit is substantially equal to the base-to-emitter voltage of said pass transistor minus the base-to-emitter voltage of said sat catcher transistor.

3. The integrated voltage regulator circuit of claim 2 wherein said collector of said sat catcher transistor is connected to a current mirror output terminal.

4. An integrated voltage regulator circuit comprising:

a PNP pass transistor having a base and a collector;

a PNP sat catcher transistor having an emitter coupled to said pass transistor collector, a base coupled to said pass transistor base, and a collector; and means coupled to said sat catcher transistor collector for varying a current flowing in said sat catcher transistor substantially in proportion to a current flowing in said pass transistor so that the base-to-emitter voltage of said sat catcher transistor rises with an increase in said pass transistor current, wherein said means coupled to said sat catcher transistor comprises:

a PNP current source transistor having an emitter, a collector and a base, said emitter and base of said PNP current source transistor connected in parallel with said emitter and base of said pass transistor, respectively, whereby a sense current is sourced from said collector of said current source transistor, and a NPN current mirror having an input terminal and an output terminal, said input terminal being coupled to said collector of said current source transistor, said NPN current mirror conducting said sense current at said input terminal, said NPN current mirror conducting from said output terminal of said NPN current mirror an output current substantially proportional to said sense current being conducted at said input terminal.

5. The integrated voltage regulator circuit of claim 4 wherein said pass transistor is much larger in area than said current source transistor whereby said sense current is a small fraction of said current flowing in said pass transistor.

6. The integrated voltage regulator circuit of claim 3 wherein said NPN current mirror output terminal is connected to the collector of said sat catcher transistor.

7. A method for reducing voltage dropout in a voltage regulator with a pass transistor, a sat catcher transistor, a sense means and a current source, said pass transistor having a base and a collector, said sat catcher transistor having an emitter, said method comprising the steps of:

conducting a first current through said pass transistor; and controlling dynamically a second current conducted by said sat catcher transistor to be substantially proportional to said first current so that a voltage between said base and said collector of said pass transistor increases with an increase in said first current, said step of controlling comprising the steps of:

providing a sense current proportional to said first current; and providing a third current proportional to said sense current, said third current varying said second current, wherein said sense means conducts said sense current and said current source conducts said second current.

8. The method of claim 7 wherein said sense current is a small fraction of said first current conducted by said pass transistor.

9. The method of claim 8 further comprising the step of conducting a fourth current through a resistor connected between said sat catcher emitter and said collector of said pass transistor.

10. The method of claim 9, wherein said fourth current increases with an increase in said third current.

11. The method of claim 9, wherein said voltage between said base and said collector of said pass transistor is substantially equal to the base-to-emitter voltage of said sat catcher transistor plus the voltage drop across said resistor.

12. The method of claim 7 wherein said voltage between said base of said pass transistor and said collector of said pass transistor is a base-to-emitter voltage of said sat catcher transistor.

13. A voltage regulator comprising:

a first PNP transistor, said first PNP transistor having an emitter, a collector and a base;

a second PNP transistor, said second PNP transistor having an emitter, a collector and a base, said emitter of said second PNP transistor coupled to said collector of said first PNP transistor, said base of said second PNP transistor coupled to said base of said first PNP transistor; and a control circuit coupled to said second PNP transistor, said control circuit controlling the current conducted by said second PNP transistor to be substantially proportional to a current flowing in said first PNP transistor so that the base-to-emitter voltage of said second PNP transistor varies in response to changes in said current flowing in said first PNP transistor, wherein said control circuit comprises:

a third PNP transistor having an emitter, a collector and a base, said emitter and base of said third PNP transistor connected in parallel with said emitter and base of said first PNP transistor respectively, whereby a sense current is sourced from said collector of said third PNP transistor, and a current mirror having an input terminal and an output terminal, said input terminal of said current mirror connected to said collector of said third PNP transistor and conducting said sense current, said current mirror conducting from said output terminal an output current substantially proportional to said sense current conducted from said input terminal.

14. The voltage regulator of claim 13 wherein said current mirror comprises:

a first NPN transistor having an emitter and a collector, said collector of said first NPN transistor connected to said input terminal of said current mirror; and a second NPN transistor having an emitter and a collector, said collector of said second NPN transistor connected to said output terminal of said current mirror.

15. The voltage regulator of claim 14, further comprising:

a first resistive element connected to said emitter of said first NPN transistor; and a second resistive element connected to said emitter of said second NPN transistor.

16. The voltage regulator of claim 13 wherein said first PNP transistor is much larger in area than said third PNP transistor whereby said sense current is a small fraction of said current flowing in said first PNP transistor.

17. The voltage regulator of claim 13 wherein said collector of said second PNP transistor is connected to said output terminal of said current mirror.

18. An integrated voltage regulator circuit comprising:

a pass transistor having a base and a collector;

a sat catcher transistor having an emitter coupled to said pass transistor collector, a base coupled to said pass transistor base, and a collector; and means, coupled to said sat catcher transistor collector, for varying a current flowing in said sat catcher transistor substantially in proportion to a current flowing in said pass transistor so that a voltage between said base and said collector of said pass transistor increases with an increase in said current flowing in said pass transistor, wherein said means coupled to said sat catcher transistor collector comprises:

a current sense means for sensing said current flowing in said pass transistor and providing a sense current, said sense current being proportional to said current flowing in said pass transistor, and a current source having an input terminal and an output terminal, said input terminal being coupled to receive said sense current, said current source conducting from said output terminal of said current source an output current substantially proportional to said sense current.

19. The integrated voltage regulator of claim 18, wherein said voltage between said base and said collector of said pass transistor is a base-to-emitter voltage of said sat catcher transistor.

20. The integrated voltage regulator circuit of claim 18, further comprising a resistive element coupled between said emitter of said sat catcher transistor and said collector of said pass transistor.

21. The integrated voltage regulator circuit of claim 20, wherein the drop out voltage of said voltage regulator circuit is substantially equal to the base-to-emitter voltage of said pass transistor minus the sum of the voltage drop across said resistive element and the emitter-to-base voltage of said sat catcher transistor.

22. The integrated voltage regulator circuit of claim 20, wherein said control means controls the current flowing through said resistive element to increase with an increase in said current conducted by said pass transistor.

23. An integrated voltage regulator circuit comprising:

a first PNP transistor, said first PNP transistor having an emitter, a collector and a base;

a second PNP transistor, said second PNP transistor having an emitter, a collector and a base, said emitter of said second PNP transistor coupled to said collector of said first PNP transistor, said base of said second PNP transistor coupled to said base of said first PNP transistor;

a first resistive element coupled between said emitter of said second PNP transistor and said collector of said first PNP transistor; and a control circuit coupled to said second PNP transistor, said control circuit controlling the current conducted by said second PNP transistor to be substantially proportional to a current flowing in said first PNP transistor, whereby the sum of the base-to-emitter voltage of said second PNP transistor and the voltage drop across said first resistive element varies in response to changes in said current flowing in said first PNP transistor, said control circuit comprising:

a third PNP transistor having an emitter, a collector and a base, said emitter and base of said third PNP transistor connected in parallel with said emitter and base of said first PNP transistor respectively, whereby a sense current is sourced from said collector of said third PNP transistor; and a current mirror having an input terminal and an output terminal, said input terminal of said current mirror connected to said collector of said third PNP transistor and conducting said sense current, said output terminal of said current mirror connected to said emitter of said second PNP transistor, said current mirror conducting from said output terminal an output current substantially proportional to said sense current conducted from said input terminal.

24. The integrated voltage regulator circuit of claim 23, wherein said current mirror comprises:

a first NPN transistor, said first NPN transistor having a collector connected to said input terminal of said current mirror;

a second NPN transistor having an emitter and a collector, said collector of said second NPN transistor connected to said output terminal of said current mirror;

a second resistive element connected to said emitter of said first NPN transistor; and a third resistive element connected to said emitter of said second NPN transistor.

* * * * *